United States Patent [19]

Urban

[11] 3,996,851

[45] Dec. 14, 1976

[54] CONTAINER PRINTING APPARATUS

[75] Inventor: Joseph J. Urban, Pleasantville, N.Y.

[73] Assignee: Crown Cork & Seal Company, Inc., Philadelphia, Pa.

[22] Filed: July 17, 1975

[21] Appl. No.: 596,649

[52] U.S. Cl. ..... 101/40; 101/247

[51] Int. Cl.[2] ..... B41F 17/08

[58] Field of Search ..... 101/38 R, 38 A, 39, 101/40, 7, 247; 118/1, 46, 218, 219, 230, 232, 233

[56] References Cited

UNITED STATES PATENTS

| | | | |
|---|---|---|---|
| 3,279,360 | 10/1960 | Smith et al. | 101/247 X |
| 3,356,019 | 12/1967 | Zurick | 101/39 |
| 3,613,571 | 10/1971 | Russell et al. | 101/247 X |
| 3,616,778 | 11/1971 | Sirvet et al. | 101/40 X |
| 3,851,579 | 12/1974 | Zurick | 101/39 |
| 3,889,630 | 6/1975 | Szpitalak | 118/46 |

*Primary Examiner*—Edward M. Coven
*Attorney, Agent, or Firm*—Woodcock Washburn Kurtz & Mackiewicz

[57] ABSTRACT

In a printing system, containers are fed to pockets associated with a plurality of mandrels located at angularly spaced positions around a mandrel drum. Each of the mandrels is supported by a mechanism including a cam follower and a load means for urging the cam follower for each mandrel outwardly toward a mandrel cam. As the drum rotates, the mandrel cam acting on the mandrel cam follower moves the mandrel radially outwardly to a position of contact with a printing blanket and a lacquer applying cylinder. In order to prevent printing or lacquering when malfunctions in container feeding occur, a locking mechanism is associated with each of the pockets of the mandrel drum. The locking mechanism is responsive to the absence of a container in a pocket as well as the improper seating of a container on a mandrel to prevent the cam follower carried by the mandrel support mechanism from following the mandrel cam when one of these conditions exists. This in turn prevents the can follower and the mandrel from moving outwardy to a position of contact with the printing blanket and the lacquer applying cylinder.

8 Claims, 26 Drawing Figures

CONTAINER PRINTING APPARATUS

BACKGROUND OF THE INVENTION

1. Field of the Invention

This invention relates to the coating of objects having exterior surfaces of revolution. This invention also relates to the printing of substantially cylindrical containers including drawn and ironed containers having integral bottom and side walls.

Printing machines of this type generally comprise a container feeding system supplying containers to a rotary drum carrying a plurality of mandrels at a plurality of angular positions around the mandrel drum. After the containers have been placed on the mandrels, the mandrels rotate to a position adjacent an offset printing blanket which is supplied by one or more printing cylinders. As the containers carried by the mandrels contact the printing blanket, print is transferred to the container. The containers then move to and engage an adjacent coater before being removed from the mandrels and placed on an outfeed conveyor.

In the ideal case, each mandrel will carry a properly seated container before reaching the printing blanket and the coater. However, certain malfunctions can and do occur in the feeding mechanism which will result in the absence of a container on the mandrel or the improper seating of a container on a mandrel. In either case, it is undesirable to have the mandrel reach the vicinity of the printing blanket and the coater since the printing and the coating may be transferrred to the mandrel itself. In the case of a missing container, the entire mandrel will be printed and coated. In the case of an improperly seated container, at least a portion of the mandrel will be printed and coated. This in turn will result in the contamination of the interior of the next container to be fed to and placed on that particular mandrel.

2. Prior Art

The foregoing problems arising out of a feeding malfunction have been recognized in the prior art. The principal approach in solving this problem has involved relative movement between the mandrel drum and the printing blanket and/or coater. When the absence of a container or the improper seating of a container is detected by suitable means such as a pneumatic detector or an electrical switch, the rotary mandrel and the printing blanket or coater have been separated momentarily to allow the mandrel of the missing or improperly seated container to pass without engaging the printing blanket and coater. In general, this involves movement of the rotary drum rather than the heavier and larger printing blanket and/or coater. Nevertheless, the size and weight of the rotary drum imposes severe limitations on the speed with which the drum can be moved from and to a position adjacent to the printing blanket and coater. This in turn imposes limitations on the output of the printing and coating machine requiring the use of more than one printing and coating machine to supply a high speed container production line or, in the alternative, slowing down the high speed container line which is of course very costly from a production standpoint. U.S. Pat. No. 3,227,070 - Brigham et al described the foregoing approach to the problem.

Another approach to the problem is shown in U.S. Pat. No. 3,496,863 - Cvacho et al. This involves the use of an adjustable cam track which cams the mandrel support mechanism radially inwardly when a feeding malfunction is detected by a suitable mechanism. When there is no feeding malfunction the cam moves the cam followers of the mandrel support mechanism through a path leading to contact between the containers carried by the mandrels and the printing blanket. In the absence of the container on a mandrel or the improper seating of a container on a mandrel, a portion of the cam guiding the cam followers is pivoted radially inwardly to force the cam follower and the associated mandrel radially inwardly away from the printing blanket. A similar camming motion occurs at the coater as the mandrel with the missing or improperly seated container approaches. This approach which involves movement of the mandrel cam is also somewhat slow since sufficient time must be left to allow the cam to move back to the normal position before the next mandrel carrying a properly seated container reaches the movable portion of the mandrel cam.

U.S. Pat. No. 3,613,571 - Russell et al discloses another approach for preventing the printing or coating of a mandrel in a high speed printing machine. This involves the use of pneumatic detectors which sense the absence of a container on a mandrel and then actuate a linking mechanism so as to rotate a mandrel supporting arm inwardly away from a printing blanket as a cam follower moves along the mandrel camming surface. Thus, the cam follower always remains in contact with the camming surface but the camming surface provides a different effect when a container is absent.

In the foregoing systems, electrical switches or fluid actuated detectors are utilized for sensing the absence or improper seating of a container on a mandrel. The detectors in turn actuate a separate mechanism for preventing contact between the mandrels and the printing blanket. Generally, a detection system of this type which involves a pneumatic or electrical transducer is less reliable than a positive and direct mechanical detection mechanism.

SUMMARY OF THE INVENTION

It is one object of this invention to provide an improved high speed coating or printing apparatus including means for preventing the coating or printing of mandrels due to the absence or improper seating of an object on the mandrel.

It is another object of this invention to provide an improved high speed printing or coating apparatus of this type which is characterized by a high degree of reliability.

In accordance with these and other objects, one embodiment of the invention comprises a mandrel drum adapted to rotate about an axis and carry a plurality of mandrels mounted on a plurality of mandrel support means at a plurality of angular positions about the mandrel drum. Means are provided to move the mandrels outwardly away from the drum axis to contact a coating transfer means located adjacent the drum so as to permit the objects carried by the mandrels to receive a coating thereon. Means are also provided to prevent the mandrels from moving outwardly when an object is not placed on a mandrel or is improperly seated on a mandrel so as to prevent contact of the coating transfer means by the mandrel under these conditions.

In a preferred embodiment, a mandrel cam is provided and the mandrels are mounted on a mandrel support means including cam followers which follow the mandrel cam so as to move the mandrels outwardly. Locking means are provided which engage the mandrel support means to prevent the cam follower from following the mandrel cam outwardly when an object is missing from or improperly seated on a mandrel. Pockets are also provided adjacent the mandrels for receiving objects prior to placing the objects on the mandrels. The locking means include object detecting surfaces which extend into the pockets so as to detect the presence and position of an object in the pocket.

DETAILED DESCRIPTION OF A PREFERRED EMBODIMENT

The Overall Machine

Figure 1:
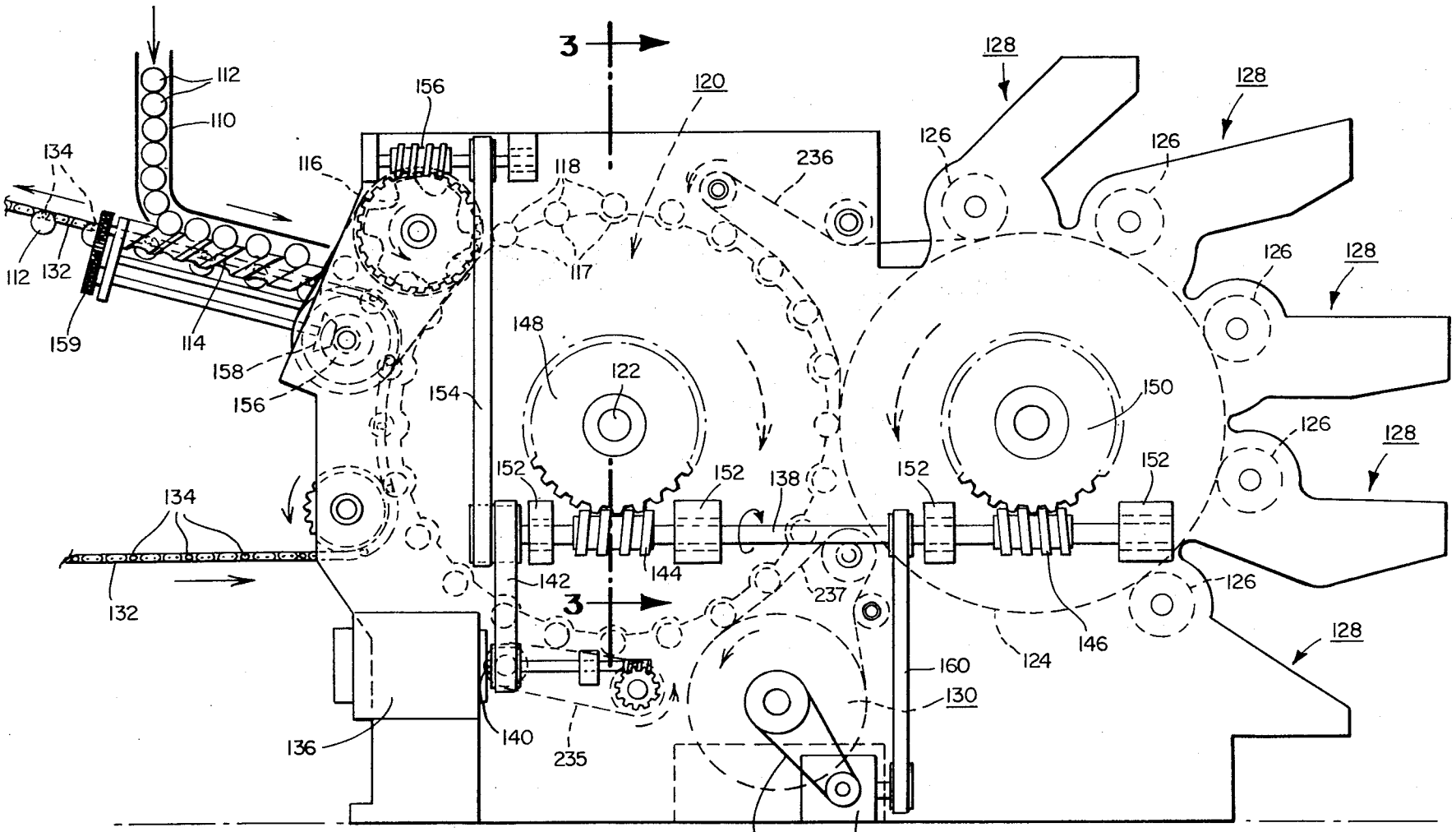
FIG. 1 is a simplified sectional view of a container printing apparatus embodying the invention.

The overall machine will first be described with respect to FIG. 1. As shown there, the machine comprises an infeed chute 110 which supplies cylindrical containers 112 having closed ends to an expanding pitch screw feed member 114 which extends along the bottom of the chute to a star wheel 116. The star wheel 116 feeds the containers, hereinafter referred to as cans, into pockets 117 adjacent rotatably mounted mandrels 118 located at angularly spaced positions along a mandrel drum 120. As the mandrel drum 120 rotates about a shaft 122 extending along its axis, the cans are pushed from the pockets 117 on to the mandrels 118.

A coating means comprising a cylindrical printing blanket 124 is provided adjacent the mandrel drum 120 in a position to contact the cans 112 carried by the mandrels as the mandrels pass the rotating blanket 124. Upon contact with the printing blanket 124, the ink which is supplied to the printing blanket 124 by rolls 126 of ink applicators 128 is transferred to the cans 112. After at least one revolution of the cans 112 in contact with the printing blanket 124, the cans move on their respective mandrels to a lacquer applying cylinder 130 which also forms part of the coating means. The cans, which move on the freely rotatable mandrels through at least one revolution in contact with the cylinder 130, then move to an outfeed conveyor chain 132 having a series of spaced pins 134. These pins 134 then carry the cans 112 to a drying oven not shown.

The drive for the various elements in the machine shown in FIG. 1 will now be described briefly. A motor 136 is the prime mover for the entire system. The central drive shaft 138 which serves to rotate the mandrel drum 120 as well as the printing blanket 124 is coupled to a drive shaft 140 of the motor 136 by a belt 142. The drive shaft 138 includes worm gears 144 and 146 associated with a drum gear 148 and a blanket gear 150 respectively. The drive shaft 138 which is supported in bearings at mounts 152 also drives a belt 154 which in turn drives a worm gear 156 associated with the star wheel 116. In order to synchronize feeding of the cans 112 to the star wheel, a chain couples the star wheel with bevel gears 156 and 158 which drive the threaded expanding pitch feed member 114 through a chain 159 as better shown in FIG. 5. The coater 130 is also driven off the shaft 138. This is accomplished by a belt 160 which is coupled to a gear box 162 which drives the lacquer applying cylinder 130 by means of a belt 166.

The overall operation of the machine shown in FIG. 1 will now be described with reference to FIG. 2. It should be understood that the positions A–Z and AA–EE represent various positions of the cans 112 as they move to mandrel drum 120, move with the mandrel drum 120 through the printing and lacquering positions, and move away from the mandrel drum 120 after transfer to the pins 134 of the outfeed conveyor 132.

In positions A, B, C and D, the cans 112 are advanced by the threaded drive member 114 shown in FIG. 1. Then, at position E the star wheel 116 moves the cans 112 into pockets 117 shown in FIG. 1 as associated with the mandrels 118. As the cans 112 are advanced from position F to position G, a reciprocating feed mechanism including a plunger 170, slides the cans 112 on to the associated mandrels 118. The motion of the plunger 170 is under the control of a feed cam 172 shown in dashed lines. A vacuum assist is also provided through the mandrels 118 to pull the cans 112 on to the mandrels as shown at position H.

As the mandrels 118 and the cans 112 move through position H, the mandrels 118 are cammed outwardly by a mandrel cam 174 to an arcuate path of interference with the printing blanket 124 corresponding to positions I–L. In positions J–M in the coating zone, the cans 112 and the mandrels 118 are given a rotating motion as indicated by the arrows so as to assure that the surface speed of the cam is substantially identical to the surface speed of the printing blanket 124.

When the mandrels 118 reach position M, the mandrel cam 174 tends to move the mandrels 118 radially inwardly so as to move the mandrels 118 through a path substantially conforming with the surface of the printing blanket 124 before the exterior surfaces of the cans 112 make contact with the printing blanket 124. After contact is made at position N, the mandrels 118 and the cans 112 are urged radially inwardly by the contact with the printing blanket 124. Then at position O, the mandrel cam 174 cams the mandrels 118 through a path conforming with the configuration of the printing blanket surface 124 so as to slowly separate the cans 112 from the blanket surface 124. The mandrel cam 174 guides the mandrels through a similar path as they move from position P through positions Q–S of another coating zone adjacent the cylindrical lacquer applying surface 130. Once again, the path of the mandrels 118 substantially conforms with the surface of the cylinder 130 both before and after contact. Also, the cans 112 and the mandrels 118 are given a rotating motion as indicated by the arrows to establish substantial equality in the surface speeds of the cans and the cylinder 130. As the mandrels move through position U to V, the mandrels and cans are braked to reduce the surface speed of the cans 112 to that of the drum in preparation for removal of the cans 112 from the mandrels 118.

At position V, the feed cam 172 advances the plunger 170 towards the mandrels 118. Simultaneously, compressed air is forced through the mandrels 118 to blow the cans 112 from the mandrel toward the plunger 170. A vacuum is now applied to a vacuum cup on the plunger 170 (not shown) so as to support the can once contact is made with the plunger 170.

With the cans 112 held by the plungers 170, the plungers 170 are angularly displaced with respect to the mandrels 118 as the cans 112 move through positions W, X, Y, Z, AA and BB by a transfer cam 176. This displacement permits the cans 112 to be aligned with pins 134 of the outfeed conveyor for an extended period of time even though the pitch of the outfeed conveyor 132 is less than that of the drum 120. At position Z, the pins 134 are substantially centered on the cans 112 and the vacuum which has been applied to the plungers 170 is terminated after which compressed air is applied to force the can away from the plungers 170 and on to the pins 134. Simultaneously, the plungers 170 are advanced toward the pins again under the influence of the cam 172. After transfer has been completed, the transfer cam 176 moves the plungers 170 back into a position of substantial alignment with the mandrels 118 and the plungers 170 are retracted to a position which permits the cans 112 to be fed into the pockets 117 of the mandrel drum 120.

THE MANDREL DRUM

The mandrel drum 120 is mounted on the shaft 122 between housing members 178. The ends of the shaft 122 are supported in bearings 180 with one end of the shaft 122 carrying the mandrel drive gear 148 which cooperates with the worm gear 144.

The structure between the mandrel housing members 178 includes fixed elements which are secured to the housing members 178 and moving elements which revolve around the shaft 122. The fixed elements comprise the feed cam 172 which is secured to the housing member by a bracket 182, the transfer cam 176 which is mounted on a bracket 183 and the mandrel cam 174 which is secured to the mandrel housing 178 by a bracket 184.

The rotating portion of the mandrel drum 120 itself comprises supporting discs 186 which are printed to the rotating shaft 122. The discs 186 support the mandrels 118 as well as the various cam followers which cooperate with the feed cam 172, the mandrel cam 174 and the transfer cam 176.

In order to support each pair of mandrels 118 at each position of the mandrel drum in a manner to permit radial outward motion with respect to the shaft 122, a mandrel arm 190 is pivotally linked with an outer shaft 192 and an inner shaft 194, each of which is pivotally supported between the supporting discs 186. Control of the mandrel position is provided by the mandrel cam 174 which cooperates with a cam follower 196 which is in turn linked with the outer shaft 192. As the cam 174 rises and falls with respect to the shaft 122, the shaft 192 is rotated in a manner so as to rotate lever arms 198 which are coupled to the mandrel arm 190. A similar motion occurs at the inner shaft 194 where lever arms 200 are also coupled to the mandrel arm 190. By providing a load cylinder 202 which is connected to another lever arm extending from the outer shaft 192 and supported at the other end by a bracket 204 which is pinned to the shaft 122, the cam follower 196 is resiliently urged against the cam 174 to vary the radial position of the mandrels 118. This radial motion of the mandrels 118 and the elements which achieve the motion will be described later in somewhat further detail with reference to FIG. 13.

The cradle-like pockets 117 and the reciprocating feed means comprising the plungers 170 are also mounted on the support discs 186 of the mandrel drum 120. The plungers 170 are supported by a bracket 208 which extends from the end of the pocket 117.

Although the operation of the plunger 170 will be described later in substantial detail with reference to FIG. 7, the following brief description is provided. A pair of pivotally mounted feed arms 210 are coupled to the plunger 170. By biasing the arms 210 to a position away from the mandrels 118 by means of springs 214 which are attached to a bracket 216, the position of the arms 210 is controlled by the feed cam 172 which cooperates with a cam follower 218. As the feed cam 172 rises and falls with respect to the shaft 122, the follower 218 which is linked to the pivotally mounted arms 210 moves toward and away from the shaft 122 so as to pivot the arms 210 and thereby reciprocate the plunger 170. By moving the plunger 170 forward through the pocket 117 after the star wheel 116 (not shown) has placed cans 112 in the pockets 117, the cans 112 may be moved on to the mandrels 118 so as to assume the position shown in FIG. 3.

The angular position of the can feed mechanism on the supporting discs 186 is varied by the interaction between the transfer cam 176 and a cam follower 220. By biasing the cam follower 220 against the transfer cam 176 by means of a spring 222, the entire feed mechanism (plunger 170 and arms 210) will pivot about the supporting shaft 224 as the cam rises and falls. This motion enables the plunger 170 to remain aligned with the pins 134 of the outfeed conveyor chain 132 for a sufficient period of time to permit transfer of the cans to the pins 134.

A detection system is also provided to sense the absence of cans 112 in the pockets 117 as well as the improper seating of cans on the mandrels 118. This comprises mechanical detecting elements in the form of a can-no-can detector 226 and an improper seating detector or jam detector 228 which extend into the pockets 117. As will be described later in somewhat more detail, the detectors 226 and 228 are scissor-like members which pivot about a shaft 230 so as to lock the cam followers 196 away from the mandrel cam in the absence of cans in the pockets 117 or when the cans are improperly seated on the mandrels 118.

A jam detector cam 232 is located behind the mandrel cam 174. This cam 232 controls the position of the jam detecting element 228 by means of a cam follower 234 attached thereto as will be described later in more detail with respect to FIGS. 11 and 12.

Figure 3:
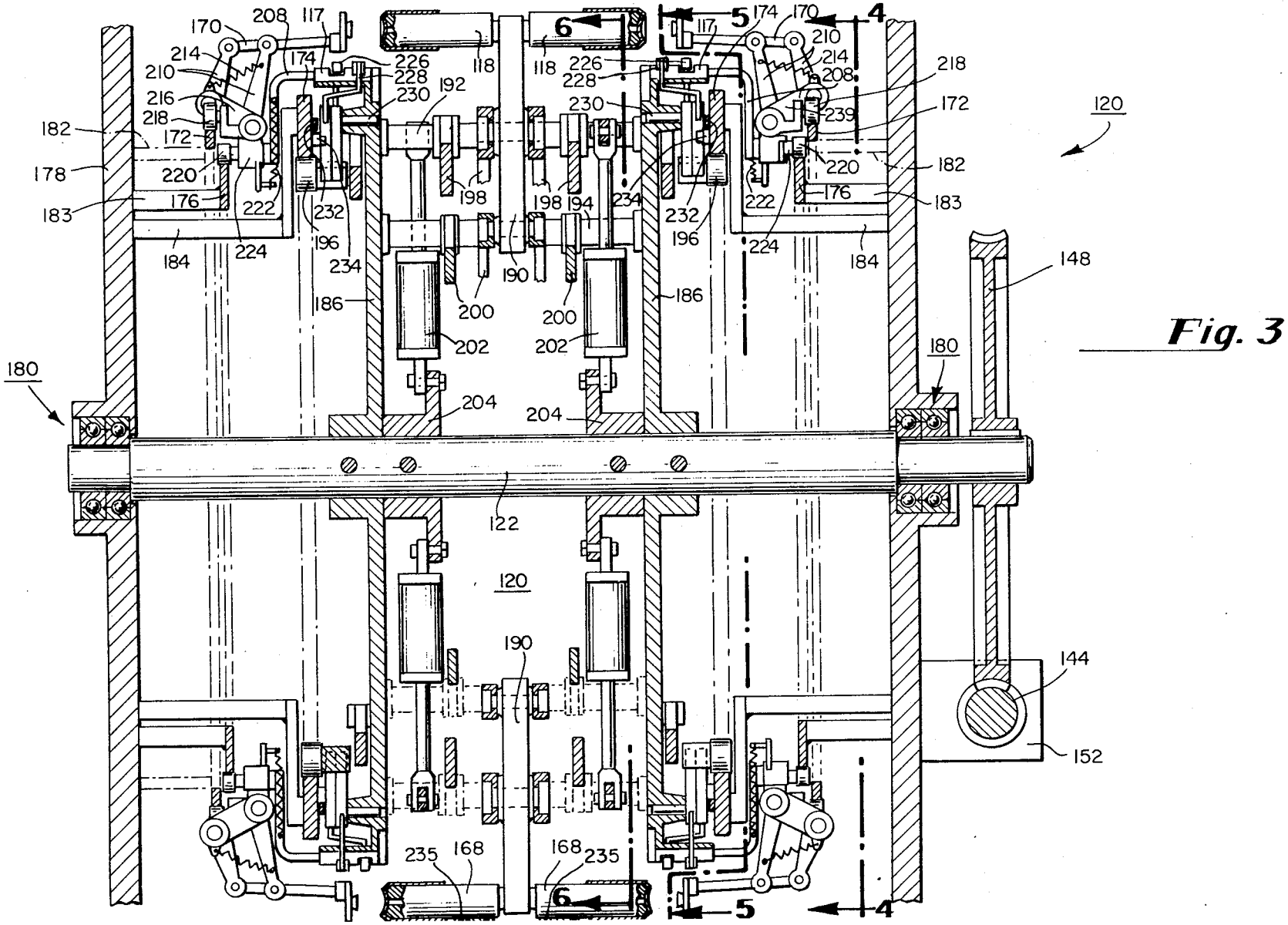
FIG. 3 is an axial sectional view of the mandrel drum shown in FIG. 1 taken along line 3—3.

FIG. 3 also shows sections of belts 235 in contact with the mandrels 118 at the bottom of the drawing. This particular belt is a braking web or belt which stops the rotation of the mandrels about their own axis prior to vacuum engagement between the plungers 170 and the ends of the cans 112. The belt 235 is also shown in FIG. 1 as well as mandrel acceleration webs or belts 236 and 237 which also engage the mandrels in a manner similar to the braking belt 235 for purposes of achieving a can surface speed which is substantially identical with the transfer surface speed of the printing blanket 124 and the surface speed of the lacquer applying cylinder 130. These belts will be described later in somewhat further detail with reference to FIG. 5.

THE FEED MECHANISM

Figure 7:
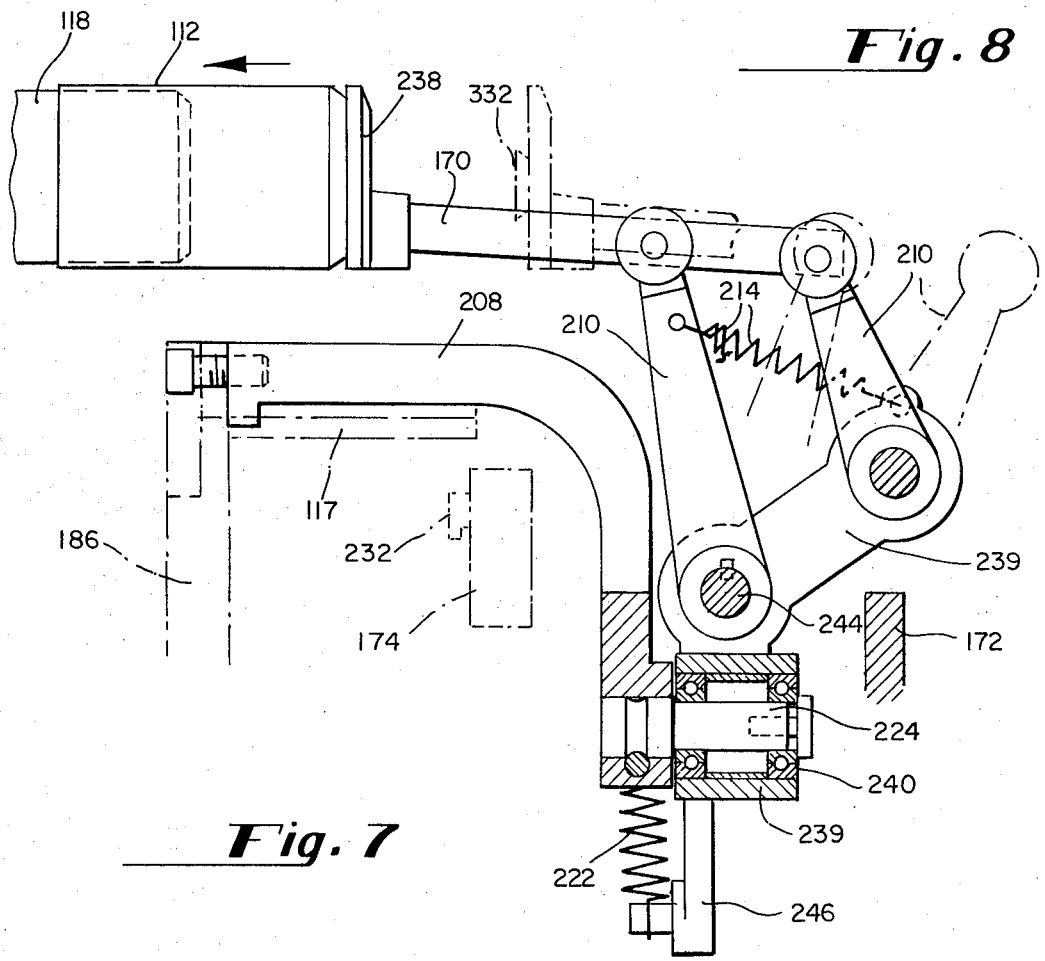
FIG. 7 is a partially sectioned view of the reciprocating feed mechanism which places containers on the mandrels.

FIG. 7 illustrates the reciprocating motion of the plunger 170 which includes a plunger head 238 which is mounted so as to have some play. As shown in full in FIG. 7, the plunger 170 and a head 238 are in the extended position with the head 238 in vacuum engagement with the can 112. As the plunger 170 and the head 238 are retracted to the position shown in broken lines, the cans 112 are pulled from the mandrels 118. This same reciprocating motion is used to push the cans 112 from the pockets 117 on to the mandrels 118 at which time the mandrels 118 are substantially axially aligned with the pockets 117.

Figure 9:
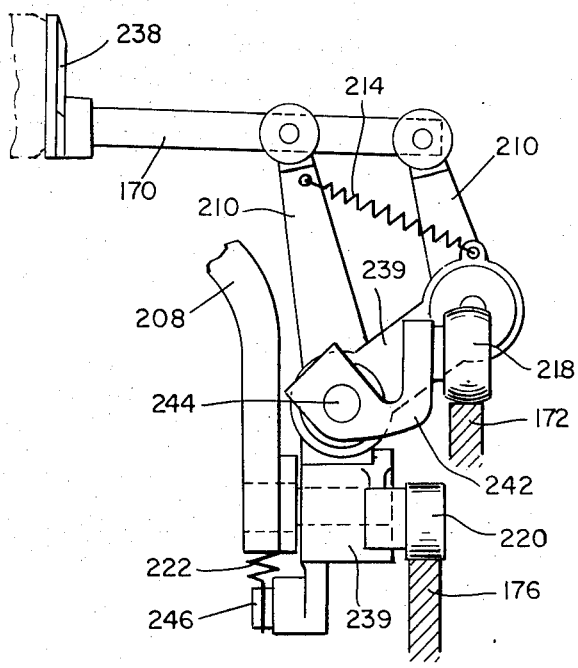
FIG. 9 is another view of the feed mechanism of FIGS. 7 and 8 showing the cams which produce the reciprocation and change of pitch of the feed means.
Figure 16:
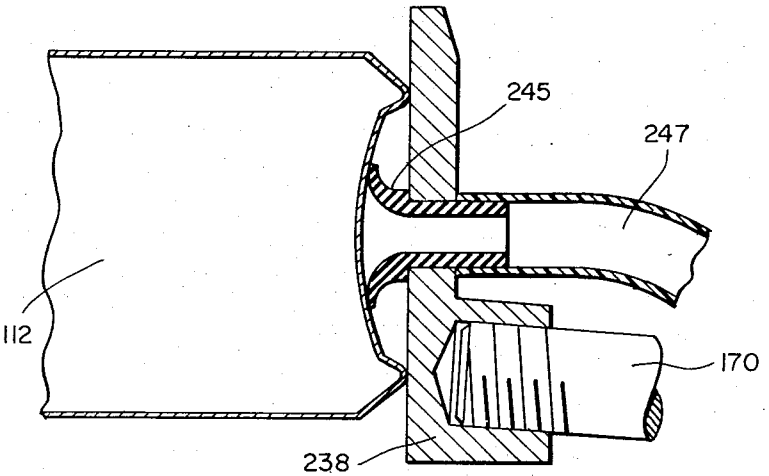
FIG. 16 is a sectional view of the head on the reciprocating feed mechanism.

FIG. 7 also illustrates the details of the feed mechanism which includes the bracket 208 carrying a housing 239 which pivots on bearings 240 around the shaft 224. When the cam 172 rises, the cam follower 218 shown im FIG. 9 as mounted on an arm 242 produces a pivoting motion of the arm 210 which is keyed to a pin 244. Thus when the cam 172 rises, both arms 210 are pivoted forward so as to move the plunger head 170 and the plunger head 238 forward through the pocket 117 with the lower portion of the head 238 engaging the end cans 112. The plunger 170 is then retracted under the bias of the spring 214 as the cam 172 falls. This motion is repeated when the cans 112 are removed from the mandrels 118 so as to bring the heads 238 forward for vacuum engagement between the heads and the cans 112 and then retract the heads 238 to a position shown in broken lines in FIG. 7 with the plunger heads 238 still in vacuum engagement with the cans for independently supporting the cans. As shown in FIG. 16, the heads 238 have a centrally located suction cup 245. When the cup 245 is coupled to a vacuum source through a tube 247, the cans 112 may be supported by the head 238.

Figure 8:
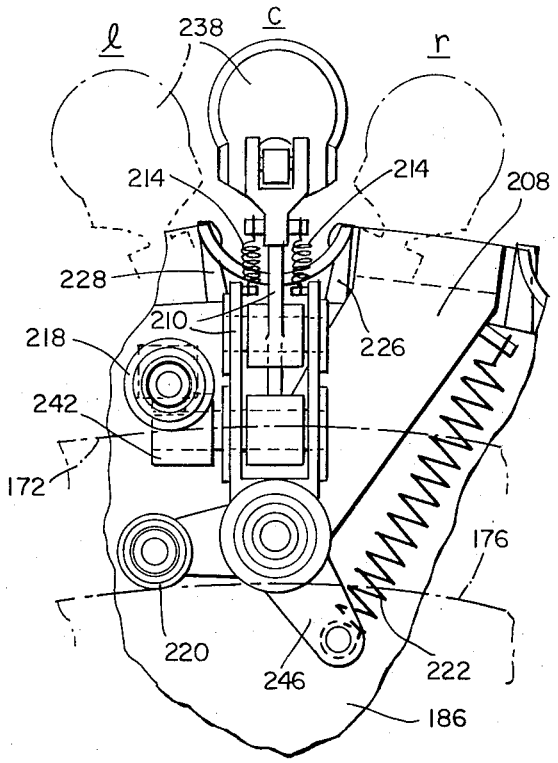
FIG. 8 is an end view of the reciprocating feed mechanism illustrating the change in pitch of the mechanism.

At this time, the plunger 170 and the entire feed mechanism begins to rotate on its housing 239 around the shaft 224. As best shown in FIG. 8, this rotation is achieved by the cooperation between the cam follower 220 and the cam 176 which angularly displaces the plunger 170 and the head 238 from the center position *c* to the right position *r* as the cam 176 rises. Then, as the cam 176 falls, the spring 222 which is secured to the bracket 208 and an ear 246 holds the cam follower 220 in contact with the cam 176 to move the plunger head 238 to the left position *l* at the left of the center position *c*.

Figure 4:
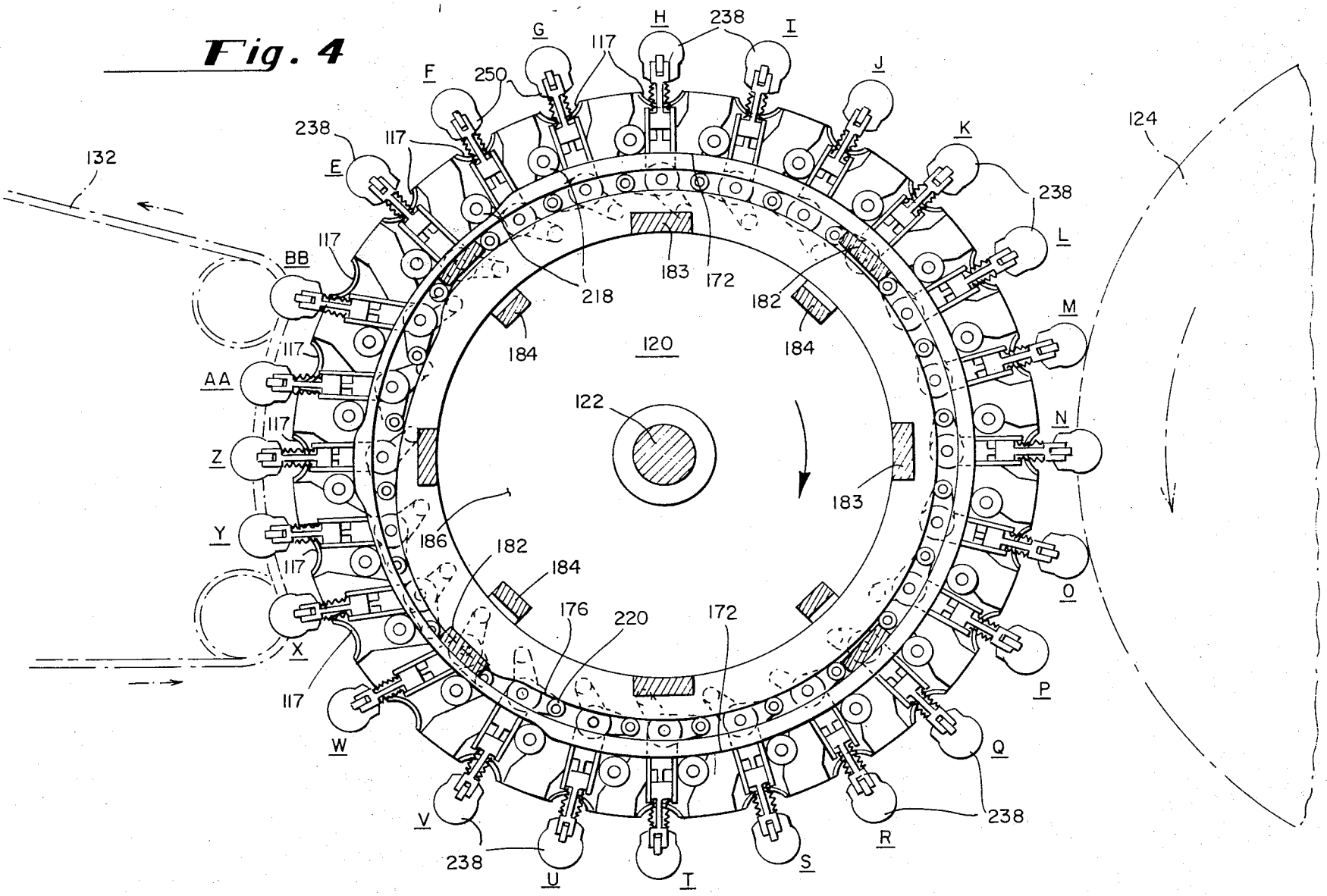
FIG. 4 is a sectional view of the mandrel drum taken along section line 4—4 of FIG. 3.

The various motions of the feed mechanism will now be described with reference to FIG. 4 wherein the various lettered positions around the mandrel drum correspond with the lettered positions shown in FIG. 2. At position E, a can 112 has just been placed in a pocket 117 when the head 238 is in the retracted position as shown in dotted lines in FIG. 7. At position F, the cam 172 begins to rise forcing the cam followers 218 outwardly so as to move the heads 238 through the pockets 117 with the bottoms 250 engaging the bottom of the cans 112. Since the mandrels 118 are substantially aligned with the pockets 117 in position F, this motion of the plunger heads 238 will push the cans 112 on to the mandrels 118 with an assist from an air blast through the plunger head 238. By also applying a vacuum at the end of the mandrels 118, the cans 112 will be pulled completely on to the mandrels 118 as the cans move through position G to position H. The heads 238 remain in this extended position through positions I–V.

At position U, compressed air is applied through the ends of the mandrels 118 and a vacuum is applied to the heads 238. After vacuum engagement is made between the heads 238 and the cans 112, the cam 172 begins to fall at position V resulting in the retraction of the heads 238 so as to pull the cans 112 off the mandrels 168.

After the cans 112 are clear of the mandrels 118, the transfer cam 176 rises and forces the cam follower 220 outwardly so as to rotate the heads 238 to the right position *r* as shown in FIG. 8. The heads 238 remain in the position *r* through position *x*. At position Y, the feed cam 172 begins to rise so as to extend the head 238 toward pins 134 (not shown) of the outfeed conveyor chain 132. Simultaneously, the transfer cam 176 begins to fall so as to move the heads 238 to the center position *c* of FIG. 8 by the time position Z of FIG. 4 is reached. At position Z, compressed air is applied through the end of the mandrels 118 to transfer the cans 112 from the extended heads 238 to the pins 134.

While the heads 238 are being retracted through position AA, the cam 176 continues to fall so as to move the heads 238 to the left position *l* shown in FIG. 8. It will therefore be seen that alignment between the cans carried by the heads 238 and the pins 134 of the chain 132 is maintained over a substantial period of time as represented by the movement of the cam through positions X, Y, Z, AA and BB.

THE MANDREL POSITIONING MECHANISM

The radial position of a mandrel will now be described with reference to FIG. 5 wherein the various lettered positions of the mandrels 118 correspond with the positions described with reference to FIG. 2. The cans are first placed in the pocket 117 at position E by the star wheel 116. At this point, the radial position of the mandrels 118 as controlled by the mandrel cam 174 is in substantial alignment with the pockets 117. This radial position of the mandrels 118 is maintained through positions F and G while transfer of the cans from the pockets 117 to the mandrels 118 occurs.

Between positions G and H, the mandrel cam 174 begins to rise and the mandrel cam follower 196 and the mandrel arm 190 are thereby extended radially outwardly until the mandrels 118 reach the position shown in positions H, I, J, K and L.

Figure 17:
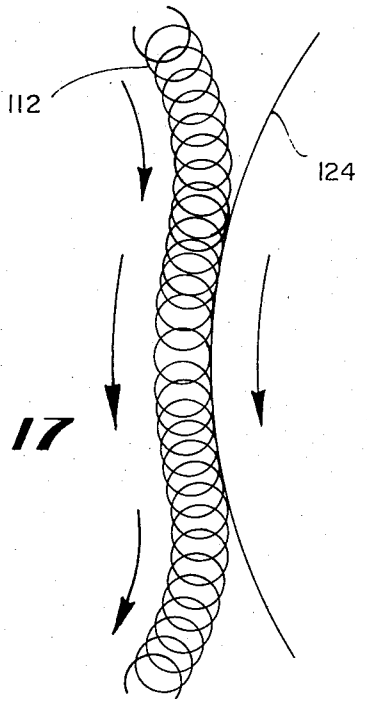
FIG. 17 is a schematic diagram illustrating the mandrel path relative to a coating transfer surface.

Between positions L and M, the mandrel cam 174 begins to fall under the influence of a mandrel cam configuration substantially conforming with the configuration of printing blanket 124 as best shown in FIG. 17 so as to produce a mandrel path substantially conforming with the printing blanket surface before contact therewith. This avoids undesirable bouncing of the mandrel on the surface of the printing blanket to assure the proper application of print. The mandrel cam 174 falls sufficiently between positions M and N so as to prevent engagement between the mandrel cam followers 196 and the mandrel cam 174. As a result, the radial position of the mandrels 118 in the positions M–O are controlled by contact with the surface of the printing blanket 124. At position O, the mandrel cam 174 again makes contact with the mandrel cam followers 196 with the cam configuration conforming with the configuration of the blanket 124 so as to produce a mandrel path substantially conforming with the surface of the printing blanket 124 as the mandrels 118 leave the printing blanket surface.

It will be observed that there is a substantial deflection of the feed mandrels 118 through positions M–O from what would otherwise be an arcuate path. With such a substantial deflection, bouncing of the mandrels 118 on the surface of the printing blanket 124 could be a considerable problem. However, by providing a mandrel path substantially conforming with the printing blanket surface before contact by the mandrels 118, this bouncing is eliminated. Similarly, the springing of the mandrels 118 radially outwardly after contact with the printing blanket surface is avoided by providing a mandrel cam configuration which produces a mandrel path substantially conforming with the surface of the printing blanket 124 after contact with the printing blanket terminates. Thus the mandrels approach the printing blanket 124 substantially tangentially and also leave the printing blanket 124 substantially tangentially as best shown in FIG. 17.

At position P, the mandrel 118 is again in the outermost radial position as it approaches the lacquer applying cylinder 130. As in the case of the printing blanket 124, the mandrel cam 174 again begins to fall and subsequently rises so as to produce a mandrel path which substantially conforms with the surface of the lacquer applying cylinder 130 both before and after contact therewith as represented by positions Q and S respectively.

At positions T, U, V and W, the mandrel remains in the outermost radial position. Then at position X, the mandrel cam 174 begins to fall and the mandrel is retracted radially inwardly as it moves through position Y to position Z. The cam 174 remains in a dwell through positions AA, BB to E where it is again aligned with the pocket 204 in preparation for receiving cans 112 from the star wheel 116.

In order to achieve mandrel cam configurations which conform with the printing blanket 124 and the lacquer applying cylinder 130, the respective rises and falls must be curved so as to have a center of curvature substantially coincident with the centers of curvatures for the printing blanket 124 and the cylinder 130.

In the foregoing description, it was assumed that the rise of the cam 174 at position H would produce outward radial motion of the mandrels 118. In general, this is the case. However, where a can is missing in the pocket 117 at position E or a can is improperly seated after the mandrel passes through positions F and G, the cam follower 196 is prevented from following the mandrel cam 174 and the mandrel 118 remains radially inwardly spaced from the printing blanket surface 124 or locked out as the drum 120 rotates. This aspect of the machine will now be described in somewhat more detail.

CAN DETECTING MECHANISM

Figure 5:
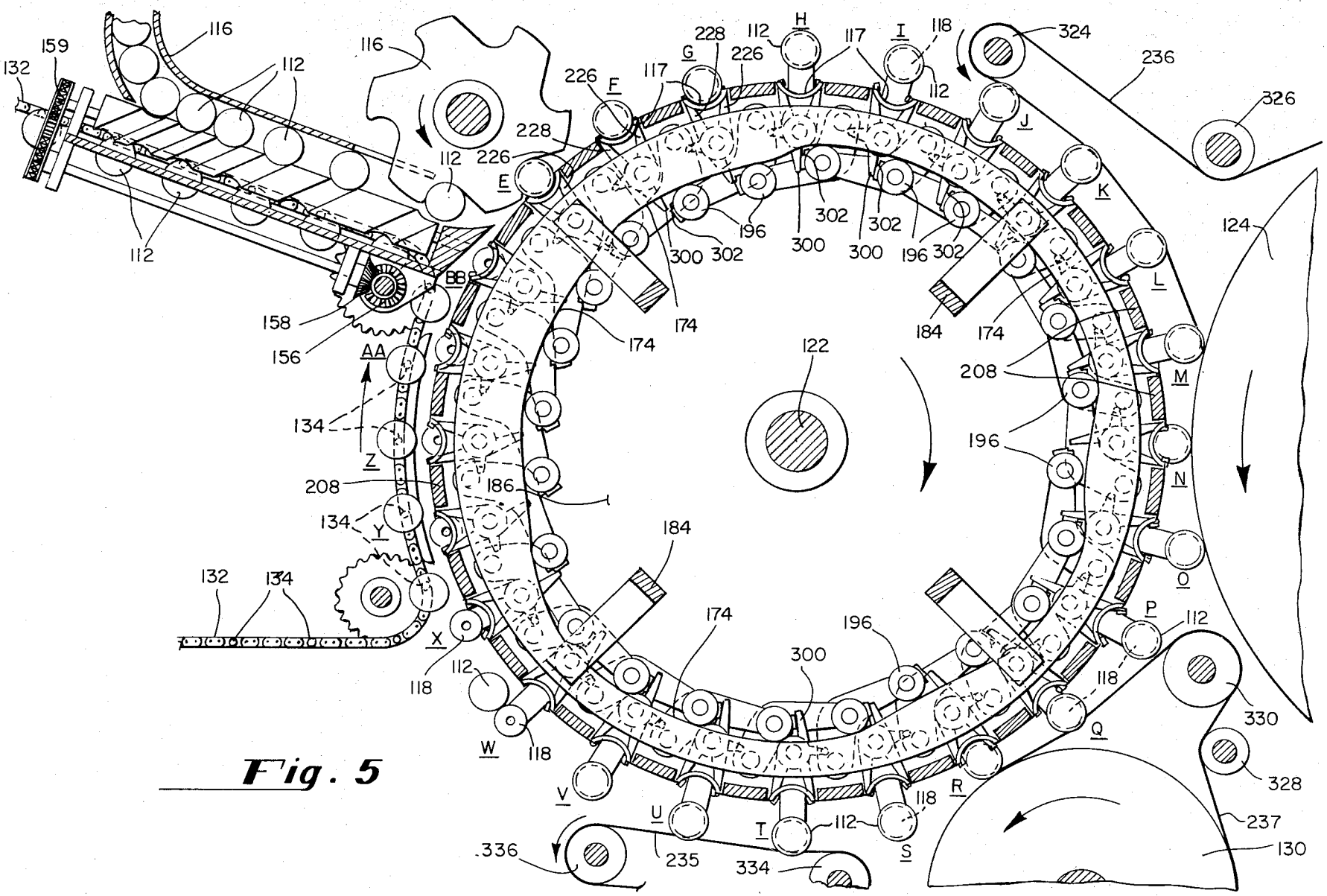
FIG. 5 is a sectional view of the mandrel drum taken along section line 5—5 of FIG. 3.

The detecting elements 226 and 228 shown in FIG. 3 are also illustrated in FIG. 5 where it may be seen that these elements form a cradle receiving the cans at position E. It can also be seen that the elements include locking surfaces 300 which are adapted to engage locking surfaces 302 of the cam followers 196. The operation of the detecting elements 226 and 228 and the interaction between locking surfaces 300 and 302 will now be described in greater detail with reference to FIGS. 10–12.

Figure 10:
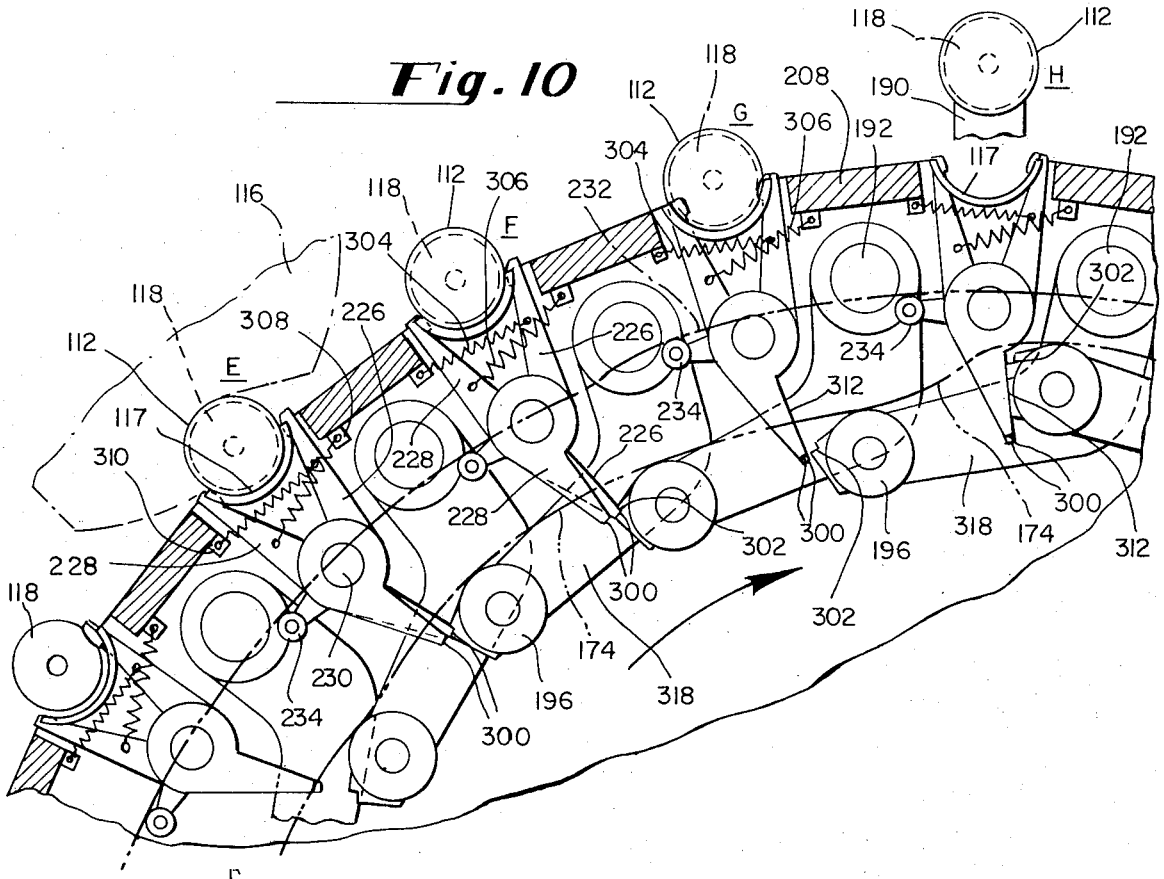
FIG. 10 is a sectional view of the mandrel drum showing the mechanism for detecting the absence of containers in the pockets of the drum or the improper seating of the containers on the mandrels.

FIG. 10 depicts positions E, F, G, and H in the mandrel drum during proper feeding such that the pockets 117 are filled with the cans 112 and the cans 112 are in turn properly seated on the mandrels 118. As shown at position E, the can 112 is placed in the pockets 117 with the scissors-like detecting elements 226 and 228 forming cradles in the pockets 117 receiving the cans 112. Both of the detecting elements 226 and 228 which pivot about the shaft 230 are biased to a closed position by springs 304 and 306 respectively. The spring 304 which is connected to the no-can detecting element 226 is secured to the mandrel drum at a hook 308. Similarly, a spring 306 which is connected to the detecting element 228 is also secured to the mandrel drum at a hook 310.

When a can is placed in a pocket 117 between the detecting elements 226 and 228, the cam follower locking surface 300 of the detecting element 226 pivots away from the locking surface 302 of the cam follower 196 as shown in FIG. 10. Note that the position of the detecting element 228 at position E and position F is not controlled by the presence or the absence of a can 112 but rather by the lockout cam follower 234 interacting with the lockout cam 232. Between positions F and G, the can 112 is placed on the mandrel 118. The lockout cam 232 rises between the positions F and G so as to permit the detecting element 228 to move into the pocket 204. If no portion of the can 112 remains in the pocket 117, the lockout cam follower 234 is permitted to follow the lockout cam 232 and the locking surface 300 on the jam detecting element 228 moves clear of the locking surface 302 on the cam followers 196 to permit the cam follower 196 to slide along the surfaces 312 of the detecting element as the mandrel cam 174 rises. In this manner, the mandrel 118 carrying the can 112 is allowed to move radially outwardly to a position of interference with the printing blanket 124 as shown in FIG. 2.

Figure 12:
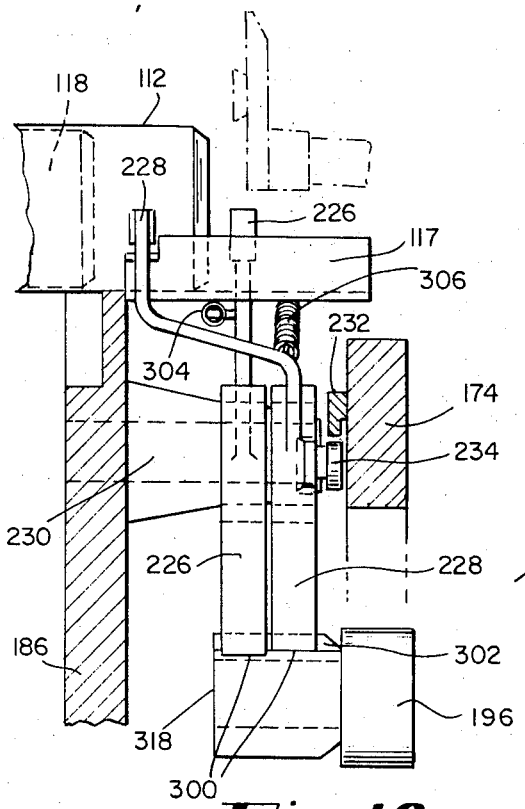
FIG. 12 is a sectional view taken along line 12—12 of FIG. 11.
Figure 11:
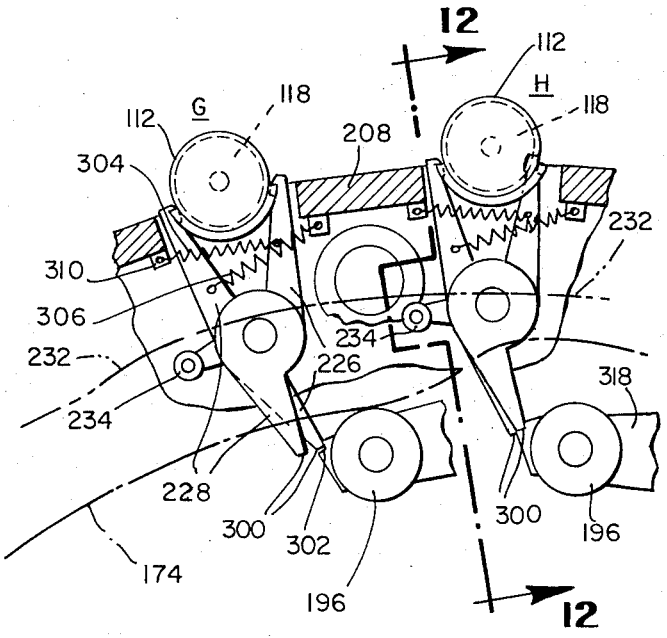
FIG. 11 depicts the container detection mechanism shown in FIG. 10 in the lock-out position resulting from the improper seating of a container on the mandrel.

FIGS. 11 and 12 depict the situation where the can 112 has become jammed on the mandrel 118. In this situation, the locking surface 300 of the no-can detecting element 226 has swung clear of the cam follower 196. Since the locking surface 302 of the no-can detecting element 226 extends slightly below the locking surface 300 of the detecting element 228, the cam follower 196 is permitted to ride up above the locking surface 300 of the no-can detecting locking element while the follower 196 is locked out by the locking surface 300 of the jam detecting element 228. If the can 112 had gone all the way on the mandrel 118, the follower 196 would then be free to rise above the locking surface 302 of the jam detecting element 228. Note that the lock-out cam follower 234 is not in contact with the lockout cam 232 due to the presence of the can.

THE MANDREL SUPPORT MECHANISM

In order to avoid skidding on the surface of the printing blanket 124 as well as the surface of the lacquer applying cylinder 130, it is important for the mandrel 118 to move substantially radially with respect to the shaft 122 of the mandrel drum when the mandrels are cammed through paths conforming with the configuration of the printing blanket surface and the lacquer applying cylinder surface by means of the mandrel cam 174. This is accomplished by the mandrel support mechanism including the mandrel support arm 190 and the shafts 192 and 194 illustrated in FIGS. 6, 13, and 14.

Figure 13:
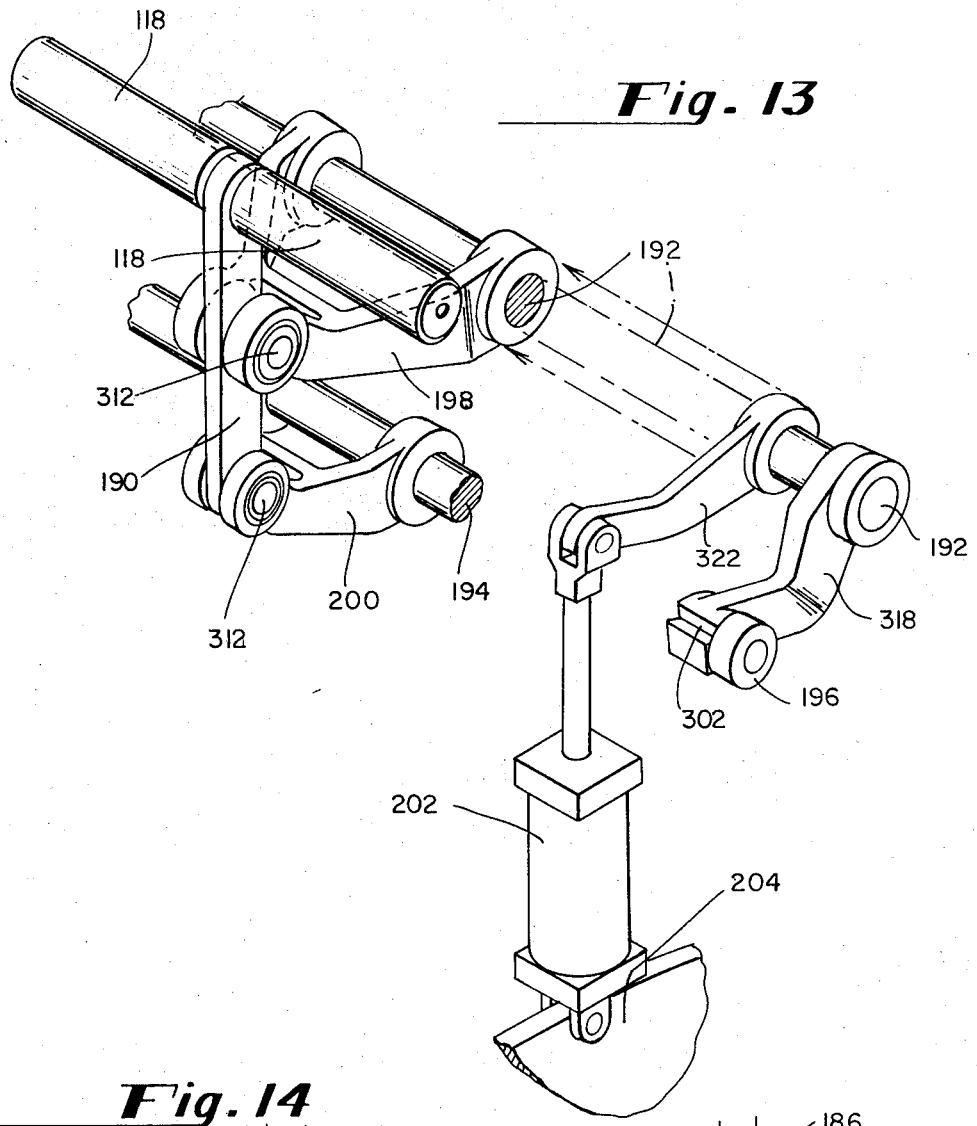
FIG. 13 is a perspective view of the mandrel support mechanism.

As shown in FIG. 13, the mandrel support arm 190 is mounted on pins 312 which extend through the V-shaped arms 314 and 316 which are fixed to the shafts 192 and 194 respectively. If the arm 190 is free to move on the pin 312, rotational motion of the shafts 192 and 194 will produce substantially vertical motion as shown in FIG. 13. It will however, be appreciated that this vertical motion is actually radial in the context of the mandrel drum 120.

Figure 14:
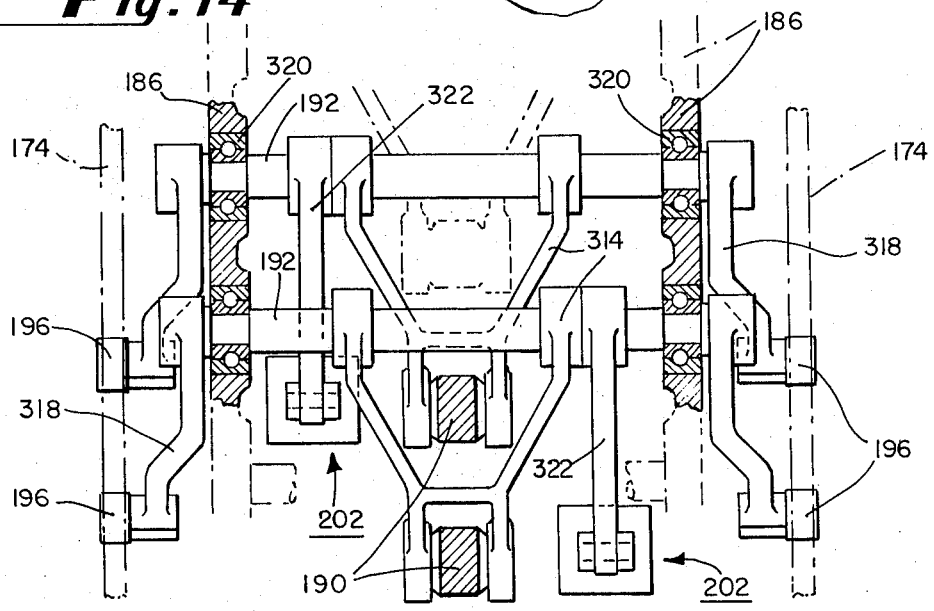
FIG. 14 is a plan view of the mandrel support mechanism.

Rotation of the shaft 192 which results in the radial motion of the mandrel arm 190 and the mandrel 118 is created by the interaction of the cam follower 196 and the mandrel cam 174 not shown in FIG. 13. As the follower 196 rises and falls, the shaft 192 which is linked with the cam follower 196 by the arm 318 will rotate in bearings 320 associated with the support disc 186 as shown in FIG. 14. The load cylinder 202 which is linked with the shaft 192 by an arm 322 is keyed to the shaft 192. In this manner, the load cylinder 202 tends to resiliently urge the cam follower 196 radially outwardly against the mandrel cam 174 to permit the mandrels 118 to move radially outwardly and inwardly with the rise and fall of the cam.

Figure 6:
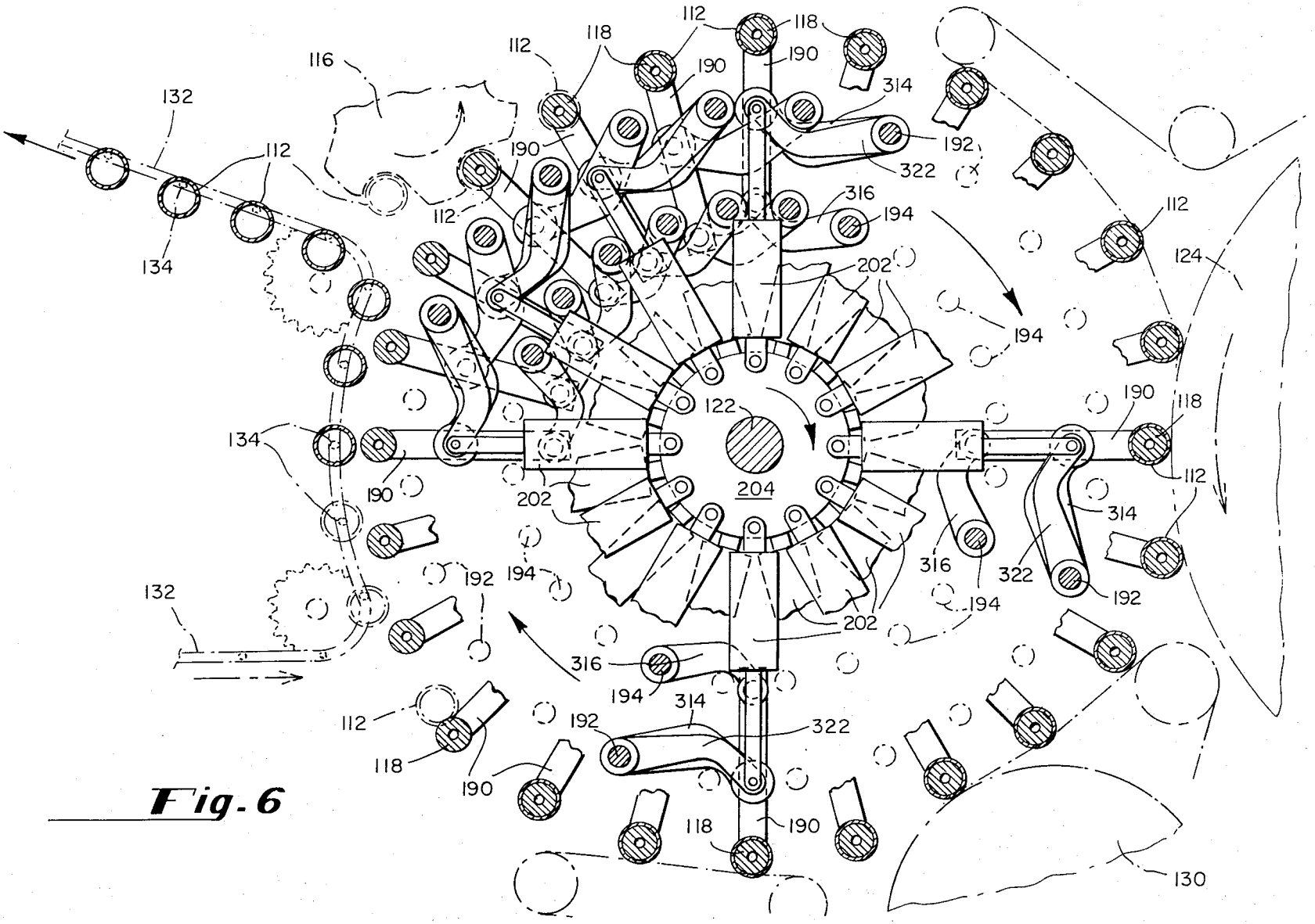
FIG. 6 is a sectional view of the mandrel drum taken along section line 6—6 of FIG. 3.

As shown in FIGS. 6 and 14, the various mandrel support mechanisms are closely spaced within the confines of the mandrel drum 120. It is for this reason that the arms 198 and 200 are V-shaped. Note that the ends of the V-shaped arms 198 and 200 at pins 312 extend into the V-shaped opening of the adjacent arms 198 and 200. Thus the mandrel support arms 190 extend through the V-shaped openings of the arms 314 and 316 of the adjacent mandrel support mechanism. Note also that a single load cylinder 202 is provided for each pair of mandrels due to the limited space available.

THE ACCELERATION AND BRAKING BELTS

To further limit skidding of the containers on the printing blanket surface 124 and the lacquer applying cylinder surface 130, the acceleration belts 236 and 237 are provided. As shown in FIG. 5, the belt 236 is driven off of the printing blanket 124 around idlers 324 and 326. By driving the belt 236 off the printing blanket 124, the surface speed of the belt 236 and the printing blanket 124 are made substantially identical. Belt 236 is then brought into engagement with the mandrels 118 through positions J, K, L and M where the mandrels 118 are in the radially extended position. This contact between the belt 236 and the mandrels 118 assures that the surface speed of the mandrels as well as the cams 112 carried by the mandrels is substantially identical with the surface speed of the printing blanket 124 thereby preventing skidding on the printing blanket surface.

Similarly, the acceleration belt 237 is driven off the lacquer applying cylinder 130 through a path established by idlers 328 and 330. The surface speed of the accelerating belt 237 is therefore substantially identical with the surface speed of the lacquer applying cylinder 130. By providing contact between the accelerating belt 237 and the mandrels 118 in positions P and Q, the mandrels are rotating at a surface speed similar to the lacquer applying cylinder 130 to eliminate any significant skidding on the surface thereof.

The braking belt 235 operates in a similar manner but for a somewhat different purpose. As shown in FIG. 5, the belt makes contact with the mandrels 118. By providing a belt speed substantially identical with the speed of the mandrel drum 120 at the mandrels, the rotational motion of the mandrels 118 is braked so as to permit vacuum engagement between the suction cups 332 of the plunger heads 238 as shown in dotted lines in FIG. 7. In order to achieve the proper speed for the braking belt 235, a drive pulley 334 is driven off a worm gear 336 which is in turn driven directly by the motor 136 as shown in FIG. 1. The belt 235 is then driven around the drive pulley 334 and an idler pulley 336.

THE MANDRELS

Figure 15:
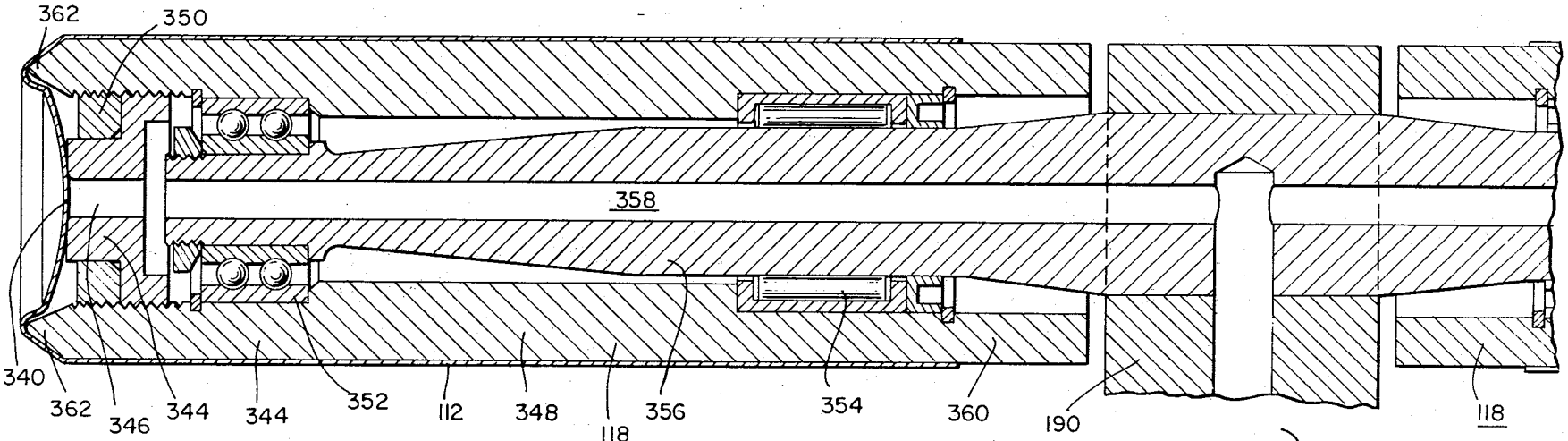
FIG. 15 is a sectional view of a mandrel.

In order to assure accurate printing of the cans 112 on the mandrels 118, it is important that the mandrels 118 contact the interior of the cans 112 along the line of contact between the cans 112 and the printing blanket 124. As shown in FIG. 15, this is accomplished by providing limited vacuum engagement between the mandrel 118 and the bottom 340 of the can 112. This prevents the hanging up of the can 112 on the mandrel 118.

In order to achieve the limited area of vacuum engagement, the recessed end 342 of the mandrel which receives the bottom 340 of the can 112 includes a rigid annular surface 344 having a central opening 346 communicating with a source of compressed air or vacuum. The annular surface 344 is held in place within the mandrel sleeve 348 by threaded engagement between the member 344 and a locking nut 350.

The end of the mandrel 118 as well as the housing 340 are free to rotate about the central axis of the mandrel on bearings 352 and 354. A central supporting member 356 including an axial bore 358 in pneumatic communication with the opening 346 is mounted on the support arm 190 of the mandrel support mechanism. The support arm 190 itself includes a pneumatic communication channel connected to the axial bore 358 of the mandrel support member 356. Note the area 360 at the end of the mandrel 118 which is adapted to be engaged by the various accelerating and braking belts.

By providing the limited area of vacuum engagement between the member 344 and bottom of the can 340, the can 112 is free to move to the left and right on the mandrel 118 as depicted in FIG. 15. Thus the printing blanket surface 124 is able to force the can 112 against the wall of the mandrel housing 344 at all times to assure uniform printing on the exterior of the can 112. This is particularly important toward the bottom 340 of the can 112 to assure printing down to the tapered surface 362 which is described in considerable detail in copending application Ser. No. 57,124, filed July 22, 1970.

SUMMARY OF THE OPERATION

Figure 18:
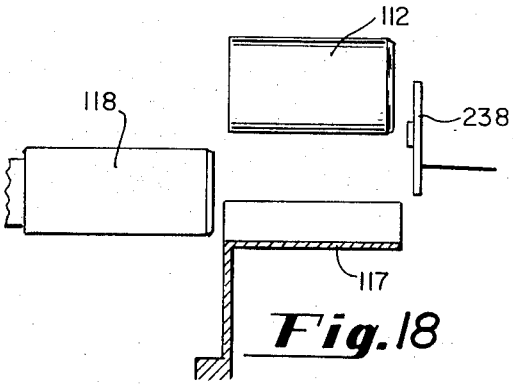
FIGS. 18–26 are pictorial-schematic diagrams illustrating various operations performed by the apparatus.

Reference will now be made to FIGS. 18–26 which represent the various phases of the rotary can printer's operation. In FIG. 18 which represents a position somewhere between position BB and position E of FIG. 2, the mandrel 118 is in alignment with the pocket 117 and the can 112 is about to be delivered to the pocket 117. At this position the plunger head 238 is retracted.

Figure 2:
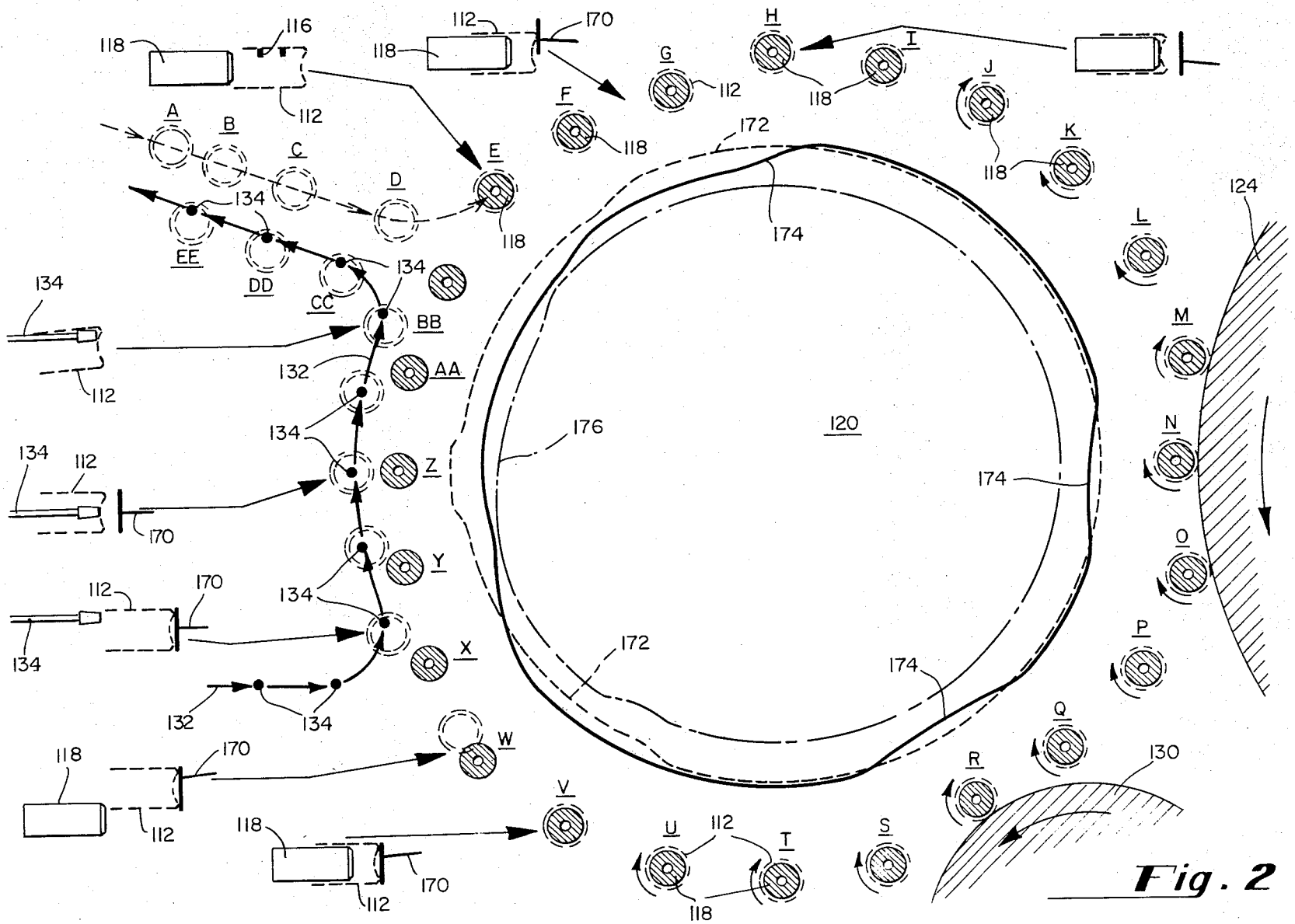
FIG. 2 is a pictorial-schematic view of containers moving through the apparatus of FIG. 1 and the operations performed at various positions therein.
Figure 19:
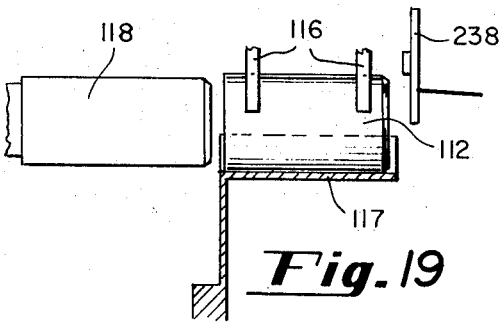

In FIG. 19 which corresponds with position E of FIG. 2, the star wheel 116 has placed the can 112 into the pocket 117. The plunger head 238 is still retracted and the mandrel 118 remains in alignment with the pocket 117.

Figure 20:
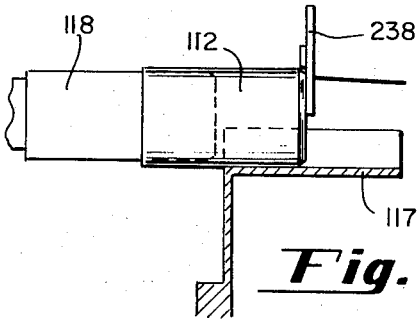

In FIG. 20 which corresponds with position G of FIG. 2, the plunger head 238 is in the extended position pushing the can 112 on to the mandrel 118. Note that only the bottom portion of the plunger lead 238 engages the bottom of the can 112. Then, in FIG. 21 which corresponds with position H of FIG. 2, a vacuum is applied to the end of the plunger 118 to pull the can 112 all the way on to the mandrel 118. The plunger head 238 remains in the extended position over the pocket 117.

Figure 22:
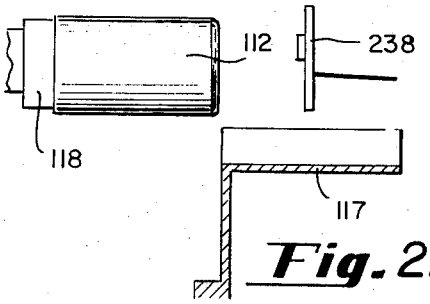

In FIG. 22 which corresponds with the positions H–V, the mandrel 118 carrying the can 112 has been moved radially outwardly to a position of substantial alignment with the plunger head 238. Of course, this position establishes a path of interference with the printing blanket 124 and the lacquer applying surface 130.

Figure 23:
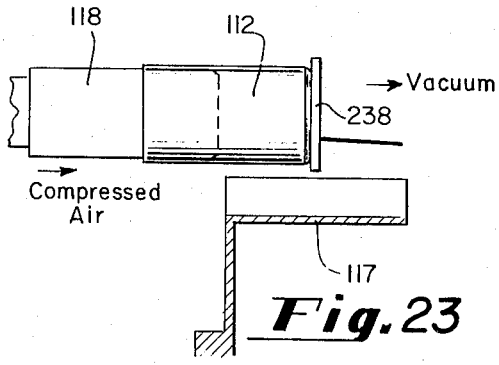

In FIG. 23 which corresponds to position V of FIG. 2, the can 112 is being removed from the mandrel 118 through the assistance of a blast of compressed air through the end of the mandrel 118 and the application of a vacuum to the plunger head 238.

Figure 24:
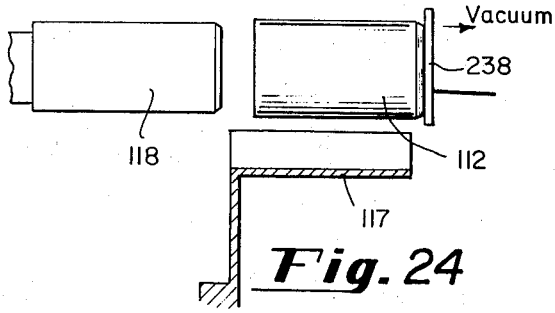

In FIG. 24, the plunger head 238 is moved to the retracted position while supporting the can 112 in vacuum engagement therewith. Note that the mandrel 118, the can 112 and plunger head 238 are still in alignment.

Figure 25:
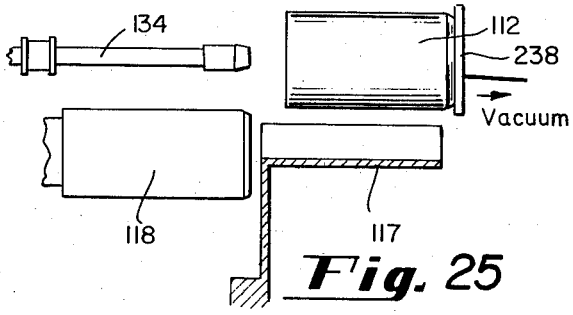
Figure 21:
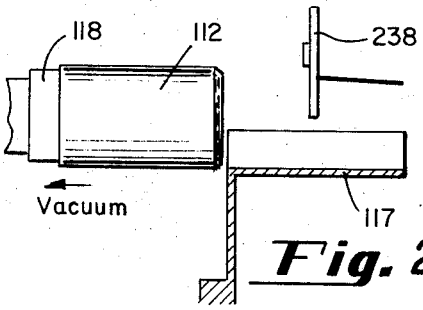
Figure 26:
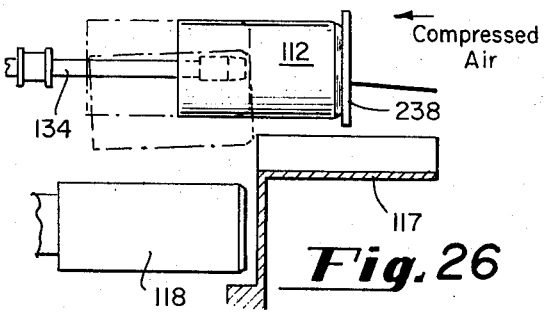

In FIG. 25 which corresponds with position X of FIG. 2, the mandrel 118 has dropped radially inwardly from a position of alignment with the can 112 and the plunger head 238 to a position of nonalignment to make room for the pin 134 which is substantially aligned with the can 112. The plunger head may now be extended to the position shown in FIG. 26. When the plunger 238 and the can 112 have reached this position, a blast of compressed air is applied through the plunger head 238 to move the can 112 on to the pin 134. This corresponds with the position V of FIG. 2.

It will of course be appreciated that a manifold must be provided to selectively and sequentially apply a vacuum to the mandrel 118 and the plunger head 238 as well as compressed air. Various types of manifolds will occur to those of ordinary skill in the art and will not therefore be described in detail. In addition to the functions previously described, the manifold may also be utilized to remove the cans from the mandrels when the mandrels are locked out away from the printing blanket 124 and the lacquer applying cylinder 130. Thus the cans 112 are blown off the mandrels 118 while the mandrels move through the locked out position. A suitable chute may be provided to carry the cans 112 away after such removal from the mandrels. In this connection, it may be desirable to angularly displace the heads 238 in the vicinity of the printing blanket 124 and the lacquer applying cylinder 130, using a modified transfer cam 176 to permit the cans to be blown free of the mandrels without striking the plunger head 238.

It will of course be appreciated that various modifications may be made in the preferred embodiment of the invention which is shown in the drawings and described in the foregoing specification. For example, the principles of this invention are equally applicable to a single mandrel machine as compared with the twin mandrel machine described. The invention is intended to cover this and other such modifications as will occur to those of ordinary skill in the art and fall within the scope of the appended claims.

What is claimed is:

1. Apparatus for coating objects having exterior surfaces of revolution comprising:

a mandrel drum adapted to rotate about the axis thereof;

a mandrel cam;

a plurality of mandrel support means mounted in a plurality of angular positions about said mandrel drum, each of said mandrel support means including a cam follower and load means for urging said cam follower radially outwardly toward said mandrel cam;

a plurality of mandrels mounted on ones of said plurality of mandrel support means for supporting ones of said objects thereon;

a coating transfer means located adjacent said drum, said coating transfer means adapted to contact said exterior surfaces of the objects as the objects move through a coating zone;

said mandrel cam being disposed radially outwardly of said cam followers for allowing said mandrels to move outwardly away from said drum axis for contacting said coating transfer means as said mandrels pass through the coating zone;

means for feeding said objects to said mandrels including a plurality of pockets associated with ones of said mandrels;

means for preventing engagement between said mandrel cam and said cam follower of said mandrel support means in response to a malfunction in feeding so as to prevent said mandrels from moving outwardly to said coating zone;

said means for preventing including a plurality of locking means mounted on said mandrel drum and associated with ones of said plurality of mandrel support means, each of said locking means engaging an associated mandrel support means and being responsive to the absence of an object in a predetermined portion of an associated pocket and to the improper seating of an object on an associated mandrel to hold the cam follower of said associated support means radially inwardly of said mandrel cam;

each of said locking means comprising a pair of movably mounted members, one of said members extending into the associated pocket so as to be moved in response to the presence or absence of an object in the associated pocket, said one member moving to a position holding said cam follower of the associated support means radially inwardly of said mandrel cam in the absence of an object in the associated pocket while moving to a position allowing said cam follower of the associated support means to move radially outwardly in the presence of an object in the associated pocket, the other of said members extending into the associated pocket so as to move in response to the proper and improper seating of an object on the associated mandrel, said other member moving to a position holding each of said cam followers radially inwardly when a predetermined portion of the object remains in the associated pocket while moving to a position allowing said cam follower of the associated support means to move radially outwardly when less than said predetermined portion of said object remains in the associated pocket.

2. The apparatus of claim 1 wherein said one movable member and said other movable member at each of said pockets comprise object detecting surfaces, the object detecting surface of said other movable member being closer to said mandrel than the object detecting surface of said one member.

3. The apparatus of claim 2 wherein said one member and said other member are pivotally mounted so as to form a cradle in said pocket between said detecting surfaces, said detecting surfaces pivoting outwardly when an object is fed into said pocket and said cradle.

4. The apparatus of claim 1 wherein said feeding means further comprises a plurality of plunger means associated with said plurality of pockets respectively, each of said pockets being substantially aligned with the associated mandrel as the associated plunger means advances during feeding so as to move said object from the associated pocket to the associated mandrel.

5. The apparatus of claim 1 wherein said coating transfer means comprises an offset printing blanket.

6. The apparatus of claim 5 wherein said coating transfer means further comprises a lacquer applying cylinder located adjacent said offset printing blanket.

7. Apparatus for printing containers having exterior surfaces of revolution comprising:

a mandrel drum adapted to rotate about the axis thereof;

a plurality of mandrel support means including cam followers mounted in a plurality of angular positions about said mandrel drum;

a plurality of mandrels respectively mounted on said plurality of mandrel support means, each of said mandrels adapted to receive a container;

a printing transfer surface located adjacent said drum, said transfer surface adapted to contact the exterior surface of said containers;

a mandrel cam disposed radially about said cam followers and cooperating therewith to allow said mandrels to move outwardly away from said drum axis to a path of interference with said printing surface;

means for feeding said containers to said mandrels including a plurality of pockets mounted on said mandrel drum and located adjacent said mandrels respectively; and locking means comprising at least one locking member extending into each of said pockets so as to be displaced by an object located therein, said locking member assuming a locking state of engagement with said support means preventing said cam follower from following said mandrel cam when said locking member is not displaced due to the absence of a container in the pocket so as to establish a path of clearance for each mandrel with respect to said printing transfer surface.

8. The apparatus of claim 7 further comprising a lacquer transfer surface located adjacent said drum, said lacquer transfer surface adapted to engage the exterior surfaces of said container, said mandrel cam permitting said mandrels to move radially outwardly to a path of interference with said printing transfer surface and said lacquer transfer surface, said locking member also establishing a path of clearance for each mandrel with respect to said lacquer transfer surface when said locking member is in said locking state.

* * * * *

UNITED STATES PATENT AND TRADEMARK OFFICE

CERTIFICATE OF CORRECTION

PATENT NO. : 3,996,851

DATED : December 14, 1976

INVENTOR(S) : Joseph J. Urban

It is certified that error appears in the above-identified patent and that said Letters Patent are hereby corrected as shown below:

Column 6, line 2, "printed" should be --pinned--.

Column 7, line 45, "im" should be --in--.

Signed and Sealed this

*ninth* Day of *August 1977*

[SEAL]

*Attest:*

RUTH C. MASON
*Attesting Officer*

C. MARSHALL DANN
*Commissioner of Patents and Trademarks*